US008444075B2

(12) United States Patent
Flath et al.

(10) Patent No.: US 8,444,075 B2
(45) Date of Patent: May 21, 2013

(54) CONCENTRATED BI-DENSITY ECCENTRIC COUNTERWEIGHT FOR CONE-TYPE ROCK CRUSHER

(75) Inventors: Darcy Alden Flath, Germantown, WI (US); Andrew Joseph Lingenfelter, Milwaukee, WI (US)

(73) Assignee: Metso Minerals Industries, Inc., Waukesha, WI (US)

( * ) Notice: Subject to any disclaimer, the term of this patent is extended or adjusted under 35 U.S.C. 154(b) by 761 days.

(21) Appl. No.: 12/560,019

(22) Filed: Sep. 15, 2009

(65) Prior Publication Data

US 2012/0223171 A1 Sep. 6, 2012

(51) Int. Cl.
*B02C 15/10* (2006.01)
*B02C 17/08* (2006.01)

(52) U.S. Cl.
USPC ..... 241/207; 241/211

(58) Field of Classification Search
USPC ..... 241/207–216
See application file for complete search history.

(56) References Cited

U.S. PATENT DOCUMENTS

| | | | | | |
|---|---|---|---|---|---|
| 2,540,358 | A * | 2/1951 | Symons | 241/84.1 |
| 2,599,543 | A * | 6/1952 | Coghill et al. | 241/214 |
| 3,219,287 | A * | 11/1965 | Weiss | 241/267 |
| 3,325,108 | A * | 6/1967 | Hansjorg et al. | 241/290 |
| 4,192,472 | A * | 3/1980 | Johnson | 241/215 |
| 4,566,638 | A * | 1/1986 | Lundin et al. | 241/37 |
| 4,750,681 | A | 6/1988 | Sawant et al. | |
| 4,779,316 | A | 10/1988 | Cherry et al. | |
| 5,355,964 | A | 10/1994 | White | |
| 5,482,218 | A * | 1/1996 | Ha | 241/30 |
| 5,615,569 | A | 4/1997 | Schlatter | |
| 5,950,939 | A * | 9/1999 | Drinkwater et al. | 241/30 |
| 5,971,306 | A * | 10/1999 | Ganser et al. | 241/207 |
| 5,996,916 | A * | 12/1999 | Musil | 241/215 |
| 6,026,776 | A * | 2/2000 | Winberg | 123/192.1 |
| 6,036,129 | A * | 3/2000 | Ambrose | 241/207 |
| 6,213,418 | B1 * | 4/2001 | Gabriel et al. | 241/207 |
| 6,688,272 | B2 | 2/2004 | Brevick et al. | |
| 7,048,214 | B2 | 5/2006 | Johnson et al. | |
| 7,566,018 | B1 * | 7/2009 | Brown et al. | 241/207 |
| 2005/0269436 | A1 * | 12/2005 | Sawant et al. | 241/215 |

OTHER PUBLICATIONS

Metso Minerals, "Nordberg MP Series Cone Crushers", Brochure No. 1219-01-02-CS, 2002, pp. 1-16.

* cited by examiner

*Primary Examiner* — Bena Miller
(74) *Attorney, Agent, or Firm* — Andrus, Sceales, Starke & Sawall, LLP

(57) ABSTRACT

A cone crusher includes a stationary main shaft and an eccentric that rotates about the main shaft to cause gyrational movement of a head assembly to crush rock within a crushing gap. The cone crusher includes a counterweight assembly mounted for rotation with the eccentric. The counterweight assembly includes a counterweight body having a series of tanks. Each tank can receive either a first ballast and a second ballast or a combination thereof. The first ballast is formed from a material having higher density than the second ballast to increase the concentration of weighting in desired locations around the counterweight assembly.

13 Claims, 5 Drawing Sheets

CONCENTRATED BI-DENSITY ECCENTRIC COUNTERWEIGHT FOR CONE-TYPE ROCK CRUSHER

BACKGROUND

The present disclosure generally relates to rock crushing equipment. More specifically, the present disclosure relates to a cone crusher including a counterweight that allows the weight and mass of the counterweight to be modified to optimize performance.

Rock crushing systems, such as those referred to as cone crushers, generally break apart rock, stone or other material in a crushing gap between a stationary element and a moving element. For example, a conical rock crusher is comprised of a head assembly including a crushing head that gyrates about a vertical axis within a stationary bowl attached to a main frame of the rock crusher. The crushing head is assembled surrounding an eccentric that rotates about a fixed shaft to impart the gyrational motion of the crushing head which crushes rock, stone or other material in a crushing gap between the crushing head and the bowl. The eccentric can be driven by a variety of power drives, such as an attached gear, driven by a pinion and countershaft assembly, and a number of mechanical power sources, such as electrical motors or combustion engines.

The exterior of the conical crushing head is covered with a protective or wear-resistant mantle that engages the material that is being crushed, such as rock, stone, or minerals or other substances. The bowl which is mechanically fixed to the mainframe is fitted with a bowl liner. The bowl liner and bowl are stationary and spaced from the crushing head. The bowl liner provides an opposing surface from the mantle for crushing the material. The material is crushed in the crushing gap between the mantle and the bowl liner.

The gyrational motion of the crushing head with respect to the stationary bowl crushes, rock, stone or other material within the crushing gap. Generally, the rock, stone or other material is fed onto a feed plate that directs the material toward the crushing gap where the material is crushed as it travels through the crushing gap. The crushed material exits the cone crusher through the bottom of the crushing gap. The size of the crushing gap determines the maximum size of the crushed material that exits the crushing gap.

During operation of a cone crusher, the gyrational movement of the head assembly and mantle and the offset rotation of the eccentric create large, unbalanced forces that are offset by a counterweight assembly connected to the eccentric for rotation therewith. Currently available counterweights include areas of relatively high density material, such as lead, to provide as much mass as possible within a restricted area. Since the size of the counterweight assembly is dictated by the cone crusher, physical limitations exist if additional weight is required for the counterweight assembly.

Since the size of the counterweight assembly is restricted, a need exists for flexibility in adjusting the mass of the counterweight assembly while not increasing the size of the counterweight assembly as compared to currently available designs.

SUMMARY

The present disclosure generally relates to a counterweight assembly for use in a cone crusher. In general, the counterweight assembly rotates along with an eccentric about a fixed main shaft in the cone crusher. The counterweight assembly provides balance for the offset rotation of the eccentric and the gyrational movement of the head assembly and mantle.

The counterweight assembly is mounted for rotation with the eccentric and includes a counterweight body having a generally annular shape. The counterweight body of the counterweight assembly in one embodiment includes both a weighted section and an unweighted section that are joined to each other to define the generally annular shape for the casting. However, it is contemplated that other counterweight assemblies could be utilized.

The weighted section of the counterweight body includes a plurality of individual tanks that each define an open interior. The individual tanks formed in the weighted section are separated from each other by vertical walls such that the open interiors of the series of tanks can be separately filled as desired.

The counterweight assembly includes a first ballast that is positioned in at least one of the plurality of tanks formed in the weighted section of the counterweight body. The first ballast is formed from a first material having a first density. In one embodiment of the disclosure, the first ballast is formed from a series of individual rods each comprised of a tungsten alloy. The first ballast is positioned in at least one of the plurality of individual tanks formed in the weighted section of the counterweight body.

In accordance with one embodiment of the disclosure, a second ballast is also positioned in at least the one tank including the first ballast such that at least one of the plurality of tanks includes both the first ballast and the second ballast. In one embodiment of the disclosure, the second ballast is formed from a second material having a second density less than the first density. As an example, the second material can be lead (Pb). In accordance with another embodiment, the second ballast is positioned in each of the plurality of tanks formed in the weighted section of the counterweight body.

Since the first ballast is formed from a material having a higher density than the second ballast, the combination of the first and second ballasts allows the counterweight assembly to have concentrated density in desired locations along the annular counterweight body of the counterweight assembly. In one embodiment of the disclosure, the second ballast is formed from lead and is poured into each of the tanks desired. The molten lead solidifies around the first ballast in each tank that includes both the first ballast and the second ballast.

In one embodiment of the disclosure, a cover member is mounted over the plurality of open tanks to enclose the tanks after the tanks have been filled with the first and second ballast. In this manner, the cover member encloses the open tanks that include the first ballast and the second ballast to prevent separation of the ballasts from the counterweight assembly.

BRIEF DESCRIPTION OF THE DRAWINGS

The drawings illustrate the best mode presently contemplated of carrying out the disclosure. In the drawings.

DETAILED DESCRIPTION

Figure 1:
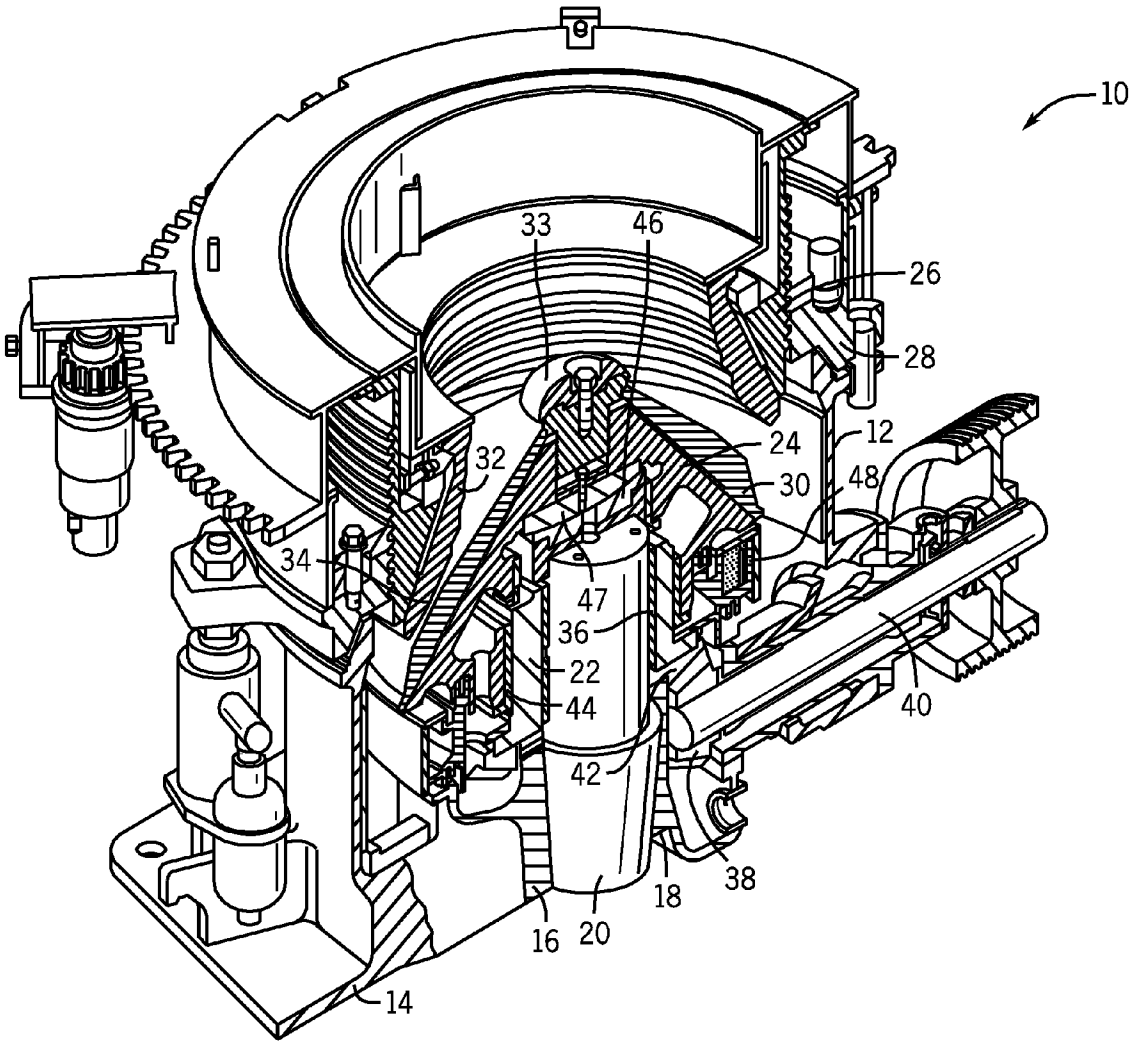
FIG. 1 is a perspective view, in partial cutaway, of a cone crusher including the counterweight assembly of the present disclosure.

FIG. 1 illustrates a cone crusher 10 that is operable to crush material, such as rock, stone, ore, mineral or other substances. The cone crusher 10 includes a mainframe 12 having a base 14. The cone crusher 10 can be any size rock crusher or include any type of crusher head. Base 14 rests upon a platform-like foundation that can include concrete piers (not shown), a foundation block, a platform or other supporting member. A central hub 16 of the mainframe 12 includes an upwardly diverging vertical bore or tapered bore 18. The bore 18 is adapted to receive a main shaft 20. The main shaft 20 is held stationary in the bore 18 with respect to the central hub 16 of the frame 12.

The main shaft 20 supports an eccentric 22 that surrounds the main shaft 20 and is coupled to a head assembly 24. The eccentric 22 rotates about the stationary main shaft 20, thereby causing the head assembly 24 to gyrate within the cone crusher 10. Gyration of the head assembly 24 within a bowl 26 that is fixed to an adjustment ring 28 connected to the mainframe 12 allows rock, stone, ore, minerals or other materials to be crushed between a mantle 30 and a bowl liner 32. The head assembly 24 includes a feed plate 33 that directs materials toward a crushing gap 34. The bowl liner 32 is held against the bowl 26 and the mantle 30 is attached to the head assembly 24. The head assembly 24 forces the mantle 30 toward the bowl liner 32 to create the rock crushing force within the crushing gap 34.

As illustrated in FIG. 1, an eccentric bushing 36 is located between the stationary main shaft 20 and the rotating eccentric 22. The eccentric 22 and the eccentric bushing 36 rotate about the stationary main shaft 20 through the interaction between a pinion 38 contained on the drive shaft 40 and a gear 42 mounted to the lower end of the eccentric 24. A supply of lubricating oil passes through the center of the stationary main shaft 20 to provide lubrication between the eccentric bushing 36 and the stationary main shaft 20.

A lower head bushing 44 is positioned between the outer surface of the eccentric 22 and the lower portion of the head assembly 24. A lubricant is received between the lower head bushing 44 and the eccentric 22 to lubricate the area of contact between the rotating eccentric 22 and the non-rotating head assembly 24.

As can be understood in FIG. 1, when the cone crusher 10 is operating, drive shaft 40 rotates the eccentric 22 through the interaction between the pinion 38 and the gear 42. Since the outside diameter of the eccentric 22 is offset from the inside diameter, the rotation of the eccentric 22 creates the gyrational movement of the head assembly within the stationary bowl 26. The gyrational movement of the head assembly 24 changes the size of the crushing gap 34 which allows the material to be crushed to enter into the crushing gap. Further rotation of the eccentric 22 creates the crushing force within the crushing gap 34 to reduce the size of particles being crushed by the cone crusher 10. The cone crusher 10 can be one of many different types of cone crushers available from various manufacturers, such as Metso Minerals of Milwaukee, Wis. As an example, the cone crusher 10 shown in FIG. 1 can be an HP® series rock crusher, such as the HP®400 available from Metso Minerals. However, different types of cone crushers could be utilized while operating within the scope of the present disclosure.

During operation of the cone crusher 10 with materials being crushed, the crushing force created in the crushing gap 34 exerts a force against the mantle 30 of the head assembly 24. This force causes the head assembly 24 to shift about the pivoting connection created by the socket liner 46 and the head ball 47. This pivoting movement causes the lower head bushing 44 to engage the eccentric 22.

As illustrated in FIG. 1, the eccentric 22 is coupled to a counterweight 48. The counterweight assembly 48 is coupled to the eccentric 22 and rotates with the eccentric about the main shaft 20. The counterweight assembly 48 is designed to offset the centrifugal forces created by the offset rotation of the eccentric 22 about the stationary main shaft 20 and offset the gyrational motion of the head assembly 27 and the mantle 30.

Figure 2:
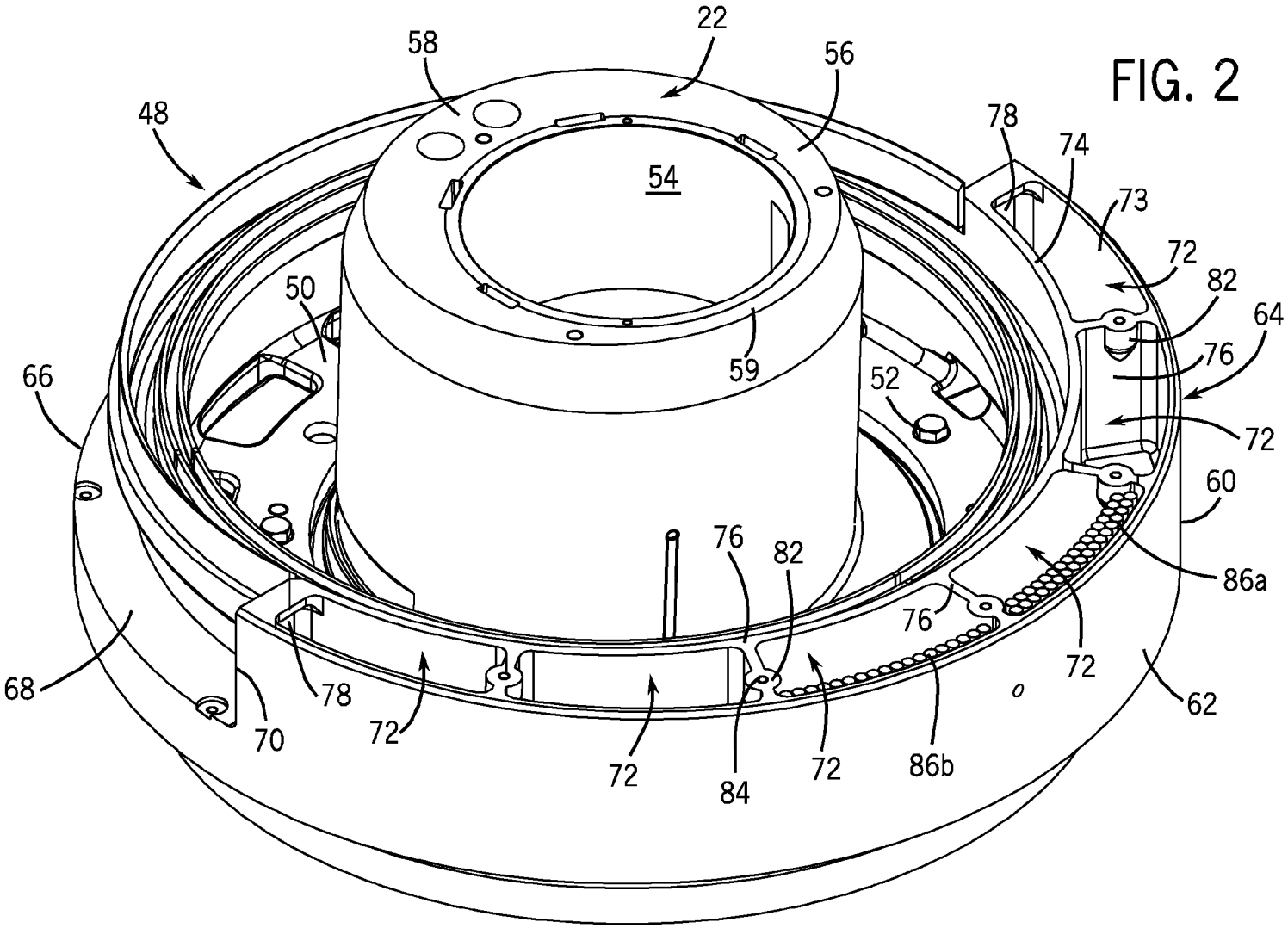
FIG. 2 is a perspective view of the eccentric and counterweight assembly constructed in accordance with the present disclosure.

Referring now to FIG. 2, thereshown is one embodiment of the counterweight assembly 48 of the present disclosure. The counterweight assembly 48 is connected to the eccentric 22 by a generally horizontal flange 50. The flange 50 includes a series of connectors 52 that securely attach the counterweight assembly 48 to the eccentric 22. As illustrated in FIG. 2, the eccentric 22 includes a central opening 54 that is surrounded by an outer wall 56 having a wide portion 58 and a thin portion 59. The varying thicknesses of the outer wall 56 creates the gyrational motion of the head assembly as the eccentric 22 rotates about the main shaft.

As illustrated in FIG. 2, the counterweight assembly 48 includes a counterweight body 60. The counterweight body 60 is a cast component formed from a base material and has the generally annular shape shown. Although the embodiment shown is a cast component, other methods of forming the counterweight body 60 are contemplated as being within the scope of the present disclosure. The counterweight body 60 includes a generally circular outer wall 62. In the embodiment illustrated, the counterweight body includes a weighted section 64 and an unweighted section 66. The weighted section 64 is generally opposite the wide portion 58 of the eccentric 22 while the unweighted section 66 is generally opposite the thin portion 59 of the eccentric 22.

In the embodiment illustrated in FIG. 2, the height of the outer wall 62 in the weighted section 64 extends above the face surface 68 of the unweighted section 66. A vertical wall 70 defines the transition between the unweighted section 66 and the weighted section 64.

In the weighted section 64, the counterweight body 60 includes a series of open tanks 72 positioned adjacent to each other and extending around the circumference of the weighted section 64. As illustrated in FIG. 2, the tanks 72 extend over approximately one half of the outer circumference of the counterweight body 60.

Figure 5:
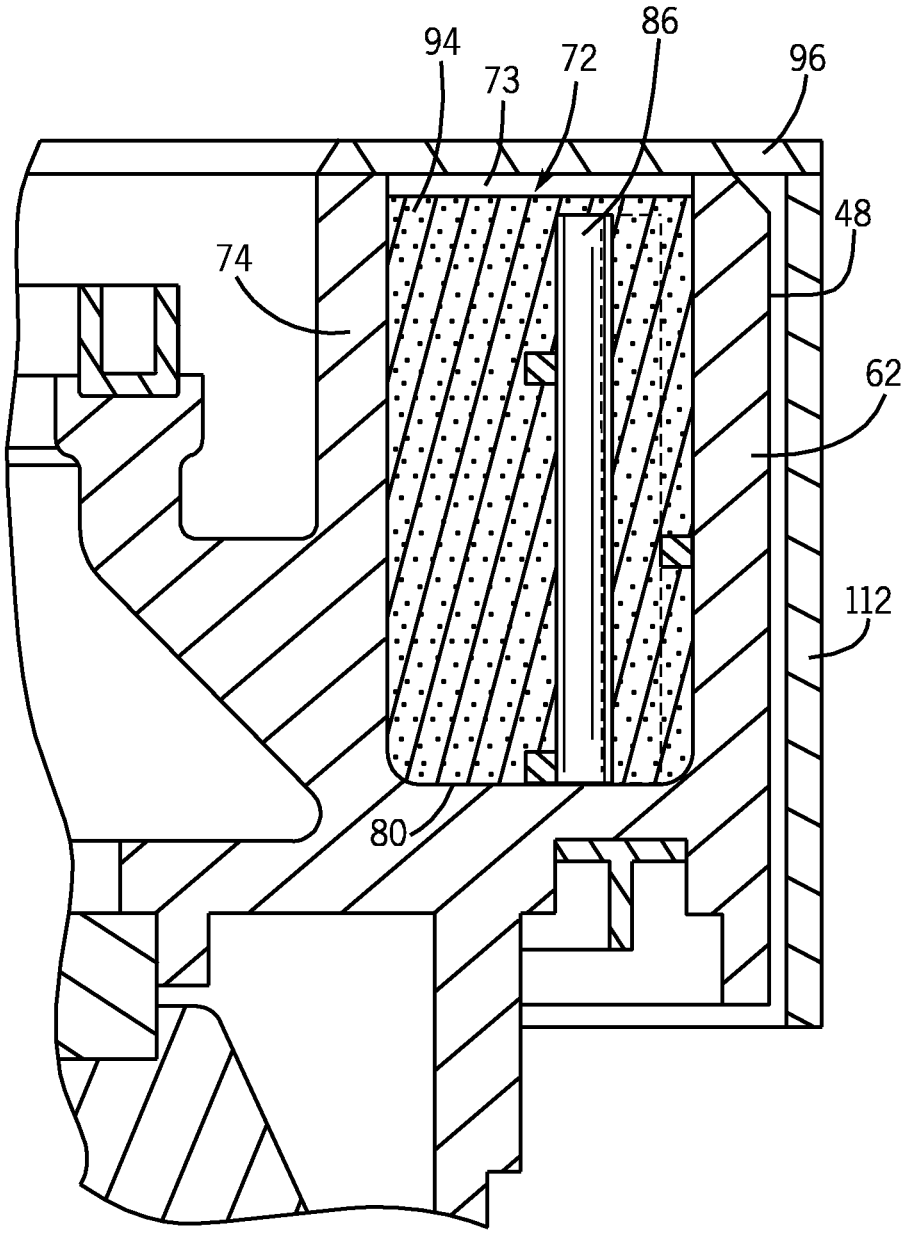
FIG. 5 is a section view taken along line 5-5 of FIG. 4.

Each of the tanks 72 includes an open interior 73 that is defined by the outer wall 62 and an inner wall 74. The spacing between the inner wall 74 and the outer wall 62 defines the radial width of each of the tanks 72. The tanks 72 are separated from each other by a vertical separating wall 76. The two end tanks 72 are each defined at their outer end by an end wall 78. As illustrated in FIG. 5, each of the tanks 72 is defined at its bottom end by a bottom wall 80. As can be understood in FIGS. 2 and 5, each of the tanks 72 defines the generally enclosed, hollow open interior 73 that can receive material in a manner to be described in much greater detail below.

Referring back to FIG. 2, each of the separating walls 76 includes an expanded receiving section 82 having a central bore 84. The receiving section 82 extends only along a portion of the vertical height of the separating wall 76, as can be seen.

Figure 3:
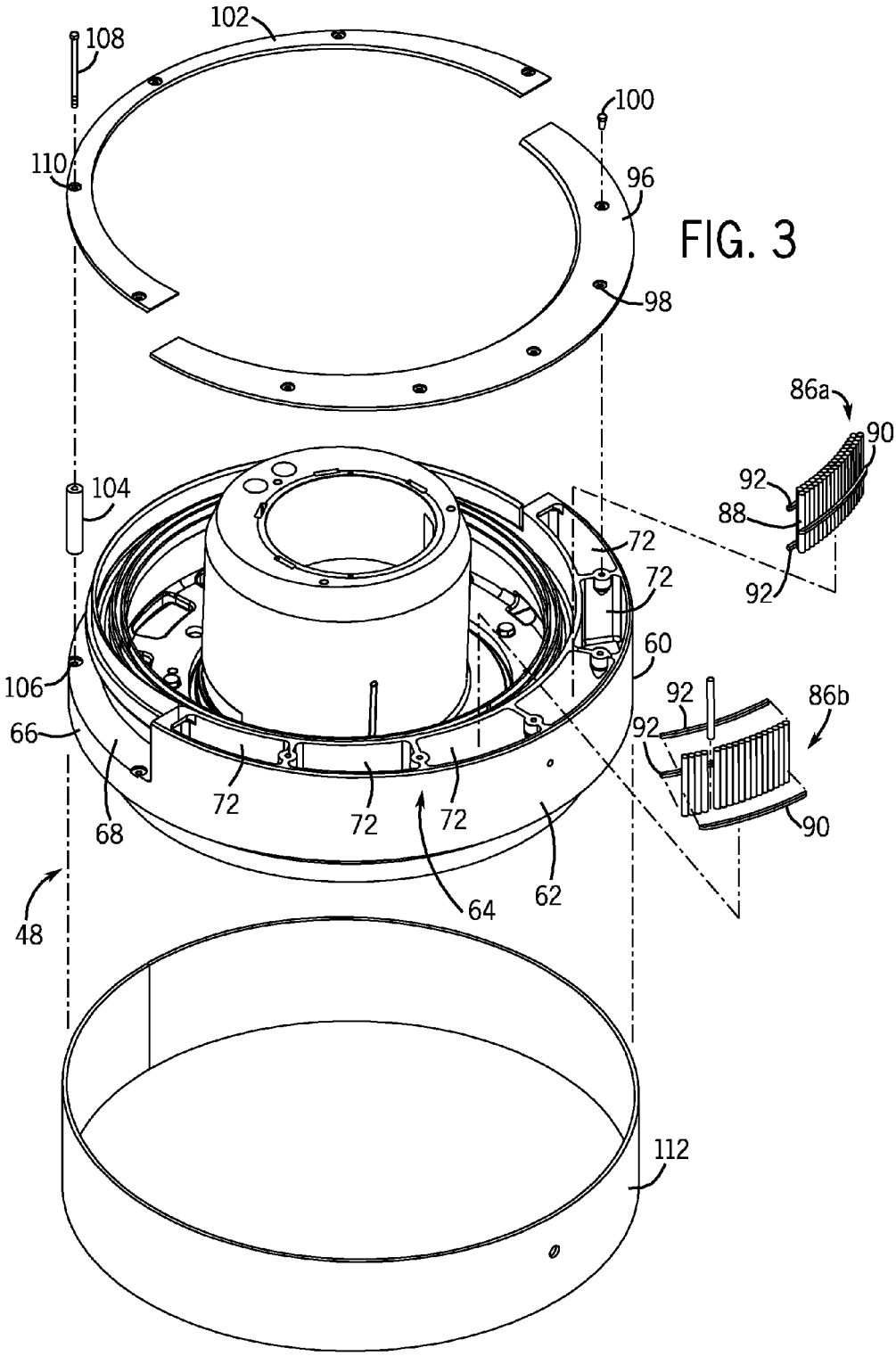
FIG. 3 is an exploded perspective view of the eccentric and counterweight assembly illustrating the positioning of ballasts within the counterweight assembly.

Referring now to FIG. 3, in the embodiment of the invention illustrated, one or more of the individual tanks 72 receives a first ballast 86. In FIG. 3, two separate first ballasts 86*a* and 86*b* are shown, although different numbers of first ballasts, such as one or three, could be utilized. In the embodiment illustrated in FIG. 3, the first ballast 86 is comprised of a series of individual weights 88 positioned to form the first ballast. In the embodiment illustrated in FIG. 3, the individual weights 88 are formed from a material different from the base material of the counterweight body, such as tungsten alloy rods joined to each other by an outer connector 90 and a pair of inner connectors 92. It is contemplated that the weights could have shapes other than rods or could be a unitary block or bar while operating within the scope of the present disclosure.

In the embodiment illustrated in FIG. 3, the first ballast 86*a* includes two rows of the tungsten rod while the first ballast 86*b* includes only a single row of tungsten rods. As will be described in detail below, the number of individual weights 88 positioned in each of the tanks 72 can be selected during the design of the counterweight assembly 48 to adjust the weighting of the counterweight assembly 48 as is desired. In the embodiment shown in FIG. 2, only two of the tanks 72 include the first ballast 86. However, it is contemplated that any number of the five tanks 72 shown in FIG. 2 could include the first ballast 86 depending upon the specific configuration of the counterweight assembly.

During creation of the counterweight assembly 48, the individual tanks 72 are filled with the first ballast 86 as desired. As described, in the embodiment shown in FIGS. 2 and 3, only two of the five tanks 72 include the first ballast 86. In the embodiment illustrated, the first ballast is formed from a very dense material, such as tungsten alloy rods. However, it should be understood that the first ballast 86 could be formed from other materials and the individual weights 88 could have other configurations other than the tungsten rods shown in FIG. 3.

Referring now to FIG. 5, once the first ballast 86 has been positioned in the tank 72, a second ballast 94 can be positioned within the tank 72 to further increase the weight of the counterweight assembly 48. In the embodiment shown in FIG. 5, the second ballast 94 is formed from a second material different from both the first material and the base material used to form the counterweight body. In the embodiment shown, the second material is lead that is poured into the open tank 72 and surrounds the first ballast 86. Although lead is shown in the embodiment of FIG. 5, it should be understood that other types of material could be utilized as the second ballast 94.

In one embodiment, after the first ballast 86 has been positioned within the tank 72, molten lead is poured into the cavity 72 to surround the first ballast 86. The molten lead that forms the second ballast 94 solidifies and fills the open interior 73 of the tank 72 as illustrated. Referring back to FIG. 2, it is contemplated that each of the five tanks 72 will be filled with the second ballast 94 while only two of the tanks 72 receive the first ballast 86.

As described above, in one embodiment of the disclosure, the first ballast 86 is formed from individual rods of tungsten alloy that has a density of approximately 17 grams per cubic centimeter. The second ballast, which in the embodiment illustrated is formed from lead, has a density of approximately 11.34 grams per cubic centimeter. Although the tungsten material that forms the first ballast 86 has a much higher density, the cost and difficulty of working with a tungsten alloy decreases the ability to use tungsten alloy as the only material within any one of the tanks 72. However, utilizing two different density materials within the tanks 72 allows the counterweight assembly to have more concentrated weight in the areas desired.

Referring now to FIG. 3, once the first ballast 86 and the second ballast 94 have been positioned in the tanks 72, a first cover member 96 is positioned to enclose each of the tanks 72 formed in the weighted section 64. The cover member 96 is a semi-circular plate having a series of openings 98 that each receive a connector 100. The connectors 100 are each received within the bore 84 formed in the receiving section 82 formed as part of the separating wall 76, as best shown in FIG. 2.

Figure 4:
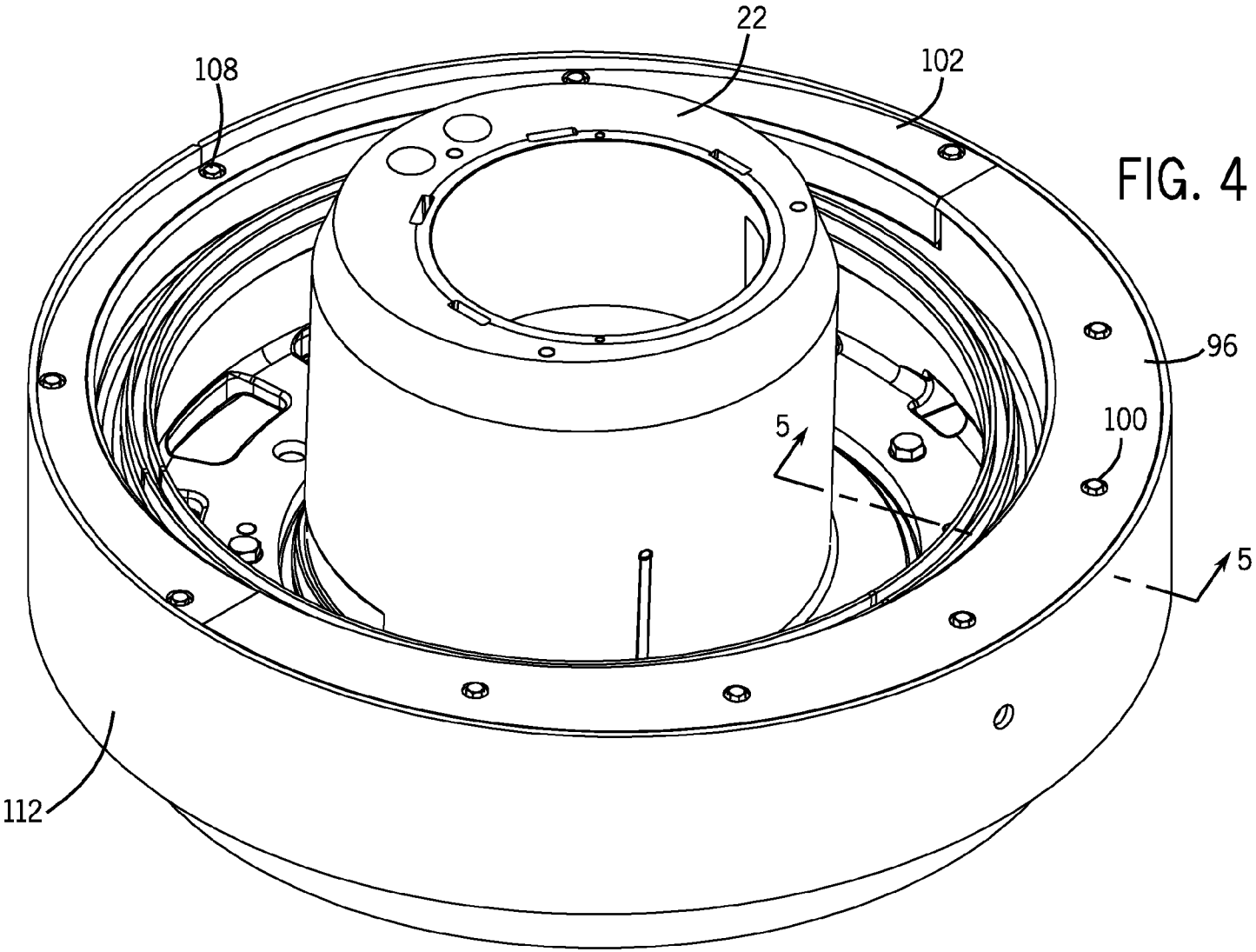
FIG. 4 is a perspective view of the counterweight assembly constructed in accordance with the present disclosure.

In addition to the first cover member, a second cover member 102 is mounted to the unweighted section 66. A series of spacers 104 are each aligned with a bore 106 formed in the face surface 68. An elongated connector 108 extends through each opening 10 formed in the second cover member 102 and extends through a central bore formed in one of the spacers 104. The threaded end of the connector 108 is received within the bore 106 to hold the second cover member 102 in general alignment with the first cover member 96, as best shown in FIG. 4. An outer ring 112 is attached to the outer wall 62 to generally enclose the eccentric, as best shown in FIG. 4.

As described previously, the first ballast 86 and the second ballast 94 are formed from different materials in accordance with the present disclosure. The first ballast 86 in the embodiment shown is formed from individual rods of a tungsten alloy while the second ballast 94 is formed from lead. However, it should be understood that different materials could be utilized while operating within the scope of the present disclosure. Most importantly, it is contemplated that the first ballast 86 will be formed from a material having a higher density than the second ballast 94. The relationship between the first ballast 86 and the second ballast 94 can vary while operating within the scope of the present disclosure.

Although specific dimensions are set forth above, it should be understood that these dimensions are for illustrative purposes only and are not meant to limit the scope of the present disclosure. Specifically, the size and configuration of the first and second ballasts could vary, which would result in various different weights for the counterweight assembly 48.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A counterweight assembly for a cone crusher, comprising:

a counterweight body formed from a base material, the counterweight body including a plurality of tanks each defining an open interior;

a first ballast positioned in at least one of the plurality of the plurality of tanks on the counterweight body, the first ballast being formed of a first material different from the base material and having a first density; and a second ballast positioned in at least one of the plurality of the plurality of tanks on the counterweight body, the second ballast being formed of a second material different from the base material and different from the first material and having a second density different from the first density, wherein the first density is greater than the second density and at least one of the plurality of tanks includes both the first ballast and the second ballast.

2. The counterweight assembly of claim 1 wherein the plurality of tanks are separated from each other such that the tanks can be filled separately.

3. The counterweight assembly of claim 2 wherein each of the plurality of tanks includes the second ballast and less than all of the plurality of tanks include the first ballast.

4. The counterweight assembly of claim 3 wherein the first ballast is formed from a plurality of tungsten alloy rods.

5. The counterweight assembly of claim 1 wherein the first allast is formed from an alloy including tungsten and the second ballast is formed from lead.

6. The counterweight assembly of claim 1 wherein the counterweight body includes a cover member that encloses the open interior of the plurality of tanks.

7. The counterweight assembly of claim 1 wherein the first ballast is formed from tungsten or tungsten alloy.

8. The counterweight assembly of claim 1 wherein the counterweight body includes a weighted section and an unweighted section joined to define a generally annular shape.

9. The counterweight assembly of claim 8 wherein the counterweight body includes the plurality of tanks formed in the weighted section of the counterweight body, each of the tanks defining an open interior.

10. The counterweight assembly of claim 9 wherein each of the tanks includes the second ballast and less than all of the plurality of tanks include the first ballast.

11. The counterweight assembly of claim 10 wherein the first ballast is formed from tungsten or a tungsten alloy and the second ballast is formed from lead.

12. The counterweight assembly of claim 11 wherein the first ballast is formed form a plurality of rods formed from tungsten or tungsten alloy.

13. The counterweight assembly of claim 9 wherein at least one of the tanks includes both the first ballast and the second ballast.

* * * * *

UNITED STATES PATENT AND TRADEMARK OFFICE

CERTIFICATE OF CORRECTION

PATENT NO. : 8,444,075 B2
APPLICATION NO. : 12/560019
DATED : May 21, 2013
INVENTOR(S) : Darcy Alden Flath and Andrew Joseph Lingenfelter It is certified that error appears in the above-identified patent and that said Letters Patent is hereby corrected as shown below:

In the Claims:

Col. 7, line 13, should read:

-- 5. The counterweight assembly of claim 1 wherein the first ballast is formed from an alloy including tungsten and the second ballast is formed from lead. --

Signed and Sealed this
Eighteenth Day of March, 2014

Michelle K. Lee

Michelle K. Lee
*Deputy Director of the United States Patent and Trademark Office*